US012263373B1

(12) United States Patent
Haas

(10) Patent No.: US 12,263,373 B1
(45) Date of Patent: Apr. 1, 2025

(54) SHOULDER EXERCISE DEVICE

(71) Applicant: Corey Haas, Crest Hill, IL (US)

(72) Inventor: Corey Haas, Crest Hill, IL (US)

( * ) Notice: Subject to any disclaimer, the term of this patent is extended or adjusted under 35 U.S.C. 154(b) by 185 days.

(21) Appl. No.: 18/200,035

(22) Filed: May 22, 2023

Related U.S. Application Data

(60) Provisional application No. 63/492,226, filed on Mar. 25, 2023.

(51) Int. Cl.
*A63B 23/12* (2006.01)
*A63B 21/00* (2006.01)

(52) U.S. Cl.
CPC ..... *A63B 23/1245* (2013.01); *A63B 21/154* (2013.01); *A63B 21/4035* (2015.10); *A63B 21/4047* (2015.10); *A63B 21/4049* (2015.10)

(58) Field of Classification Search
CPC . A63B 21/04; A63B 21/0407; A63B 21/0414; A63B 21/055; A63B 21/0552; A63B 21/0555; A63B 21/0557; A63B 21/15; A63B 21/151; A63B 21/154; A63B 21/169; A63B 21/22; A63B 21/4035; A63B 21/4045; A63B 21/4047; A63B 21/4049; A63B 23/03508; A63B 23/1245
See application file for complete search history.

(56) References Cited

U.S. PATENT DOCUMENTS 588,017 A * 8/1897 Sandow ..... A63B 21/0552 482/129
4,204,719 A * 5/1980 Murphy ..... F16C 13/006 16/98
4,275,880 A * 6/1981 Murphy ..... F16C 19/507 482/43
4,340,215 A * 7/1982 Murphy ..... A63B 21/4009 16/98
4,340,216 A * 7/1982 Murphy ..... F16C 19/507 212/337
4,356,902 A * 11/1982 Murphy ..... F16C 19/507 384/418
4,632,392 A * 12/1986 Peyton ..... A63B 21/0618 482/110

(Continued)

FOREIGN PATENT DOCUMENTS

KR 20180107574 A * 10/2018 ..... A63B 21/055

*Primary Examiner* — Gary D Urbiel Goldner
(74) *Attorney, Agent, or Firm* — Donald J. Ersler

(57) ABSTRACT

A shoulder exercise device preferably includes a central handle, a stationary origin post, at least two stationary posts and a resistance line. The central handle preferably includes an upper pivot ring, a lower pivot ring, a rotating handle and a plurality of first pivoting pulley yokes. The rotating handle is rotatably retained between the upper and lower pivot rings. A plurality of pivot extensions extend from an outer perimeter of the upper and lower pivot rings to pivotally retain the plurality of first pivoting pulley yokes. Each first pivoting pulley yoke rotatably retains a line pulley. The stationary origin post includes a line retainer and a line retention projection. Each stationary post includes a second pivoting pulley yoke. The resistance line is fixed to the stationary origin post and then inserted through the plurality of first pivoting pulley yokes of the central handle, the second pivoting pulley yokes of the at least two stationary posts, respectively, and back to the stationary origin post.

20 Claims, 3 Drawing Sheets

(56) References Cited

U.S. PATENT DOCUMENTS

| | | | | | |
|---|---|---|---|---|---|
| 5,016,874 | A * | 5/1991 | Boardman | A63B 21/0552 | 482/122 |
| 5,498,223 | A * | 3/1996 | Iams | A63B 21/1654 | 482/121 |
| 5,624,362 | A * | 4/1997 | Wilson | A63B 21/156 | 482/102 |
| 5,718,654 | A * | 2/1998 | Kennedy | A63B 21/4035 | 482/102 |
| 6,942,487 | B2 * | 9/2005 | Corbalis | A63B 69/0093 | 472/91 |
| 7,666,126 | B2 * | 2/2010 | Rempe | A63B 26/003 | 482/121 |
| 9,114,298 | B2 * | 8/2015 | Ruggiero | A63B 69/20 | |
| 10,434,365 | B2 * | 10/2019 | Mack | A63B 21/0552 | |
| 2003/0153440 | A1 * | 8/2003 | Kim | A63B 21/156 | 482/122 |
| 2004/0082448 | A1 * | 4/2004 | Martin | A63B 21/4017 | 482/139 |
| 2005/0192170 | A1 * | 9/2005 | Cleveland | A63B 23/03508 | 482/148 |
| 2013/0079203 | A1 * | 3/2013 | Jones | A63B 21/151 | 482/130 |
| 2014/0357458 | A1 * | 12/2014 | Callanan | A63B 21/0442 | 482/129 |
| 2015/0314159 | A1 * | 11/2015 | Buckman | A63B 21/00065 | 482/129 |
| 2021/0260436 | A1 * | 8/2021 | McCrea | A63B 21/0552 | |

* cited by examiner

SHOULDER EXERCISE DEVICE

CROSS-REFERENCES TO RELATED APPLICATIONS

This is a non-provisional patent application which claims the benefit of patent application No. 63/492,226, filed on Mar. 25, 2023.

BACKGROUND OF THE INVENTION

1. Field of the Invention

The present invention relates generally to physical therapy and more specifically to a shoulder exercise device, which may be used by an individual to strengthen muscles of the shoulder without the aid of a therapist.

2. Discussion of the Prior Art

Shoulder exercises help strengthen the rotator cuff muscles, deltoid muscles, and various other adjacent muscle groups. Strengthening the shoulder muscles is beneficial not only for functional strength but also to restore strength to a shoulder after various shoulder surgeries. A physical therapist is trained to rehabilitate post operative shoulders by using a variety of exercises that isolate individual muscles/muscle groups with different movements which are done with gradual increases in resistance. Certain exercise techniques using resistance via resistance tubing/bands or exercise machines can be performed solely by the rehabilitating person while other strengthening exercises have to be completed with the assistance of a therapist.

Accordingly, there is a clearly felt need in the art for a shoulder exercise device, which allows an individual to strengthen certain muscles of the shoulder without the aid of a therapist and may be mounted to a vertical surface, such as a wall.

SUMMARY OF THE INVENTION

The present invention provides a shoulder exercise device, which may be mounted to a vertical surface, such as a wall. The shoulder exercise device preferably includes a central handle, a stationary origin post, at least two stationary posts and a resistance line. The central handle preferably includes an upper pivot ring, a lower pivot ring, a rotating handle, a plurality of pivoting pulley yokes and a plurality line pulleys. The rotating handle preferably includes a handle ring, a plurality of ball bearings and a handle portion. Opposing ends of the handle portion are attached to handle tabs, which extend from an inner perimeter of the handle ring. A bearing groove is formed in an outer perimeter of the handle ring to receive the plurality of ball bearings. The upper pivot ring includes an upper handle bore and a plurality of upper pivot extensions. The upper handle bore is sized to receive the rotating handle. A plurality of upper pivot extensions extend from an outer perimeter of the upper pivot ring. An upper pivot hole is formed through each upper pivot extension. The lower pivot ring includes a lower handle bore and a plurality of lower pivot extensions. The lower handle bore is sized to receive the rotating handle. A plurality of lower pivot extensions extend from an outer perimeter of the lower pivot ring. A lower pivot hole is formed through each lower pivot extension.

Each pivoting pulley yoke includes a pulley yoke, a pivot tab and a pulley. The pivot tab extends from the pulley yoke.

The pulley yoke includes an inner slot which is sized to receive a thickness of the line pulley. A fastener hole is formed through the pulley yoke to receive a pulley fastener. The pulley fastener pivotally retains the pulley in the pulley yoke. A pivot hole is formed through the pivot tab. The pivot hole is preferably perpendicular to the pulley fastener. A pivot fastener is retained in the upper pivot hole, the lower pivot hole and the pivot hole to pivotally retain the pivoting pulley yoke. The stationary origin post includes a stationary origin base, a stationary origin upright member, a line retainer and a line retention projection. The upright member extends upward from the stationary origin base. A top of the stationary origin upright member is terminated with line retainer. The line retainer includes a line origin hole and a line passthrough hole. The line retention projection extends from a rear of the stationary upright origin member.

The stationary post includes a stationary base, a stationary upright member and the pivoting pulley yoke. The stationary upright member extends upward from the stationary base. A pivot slot is formed in a top of the stationary upright member to receive the pivoting pulley yoke. The pivoting pulley yoke is pivotally engaged with the stationary upright member with a pivot fastener. In use, the bases of the stationary origin post and the stationary post are mounted to a vertical surface, such as a wall. One end of the resistance line is inserted through the line origin hole of the stationary origin post and knotted anchor thereof. The resistance line is inserted through a first pulley of the central handle; a pulley of a first stationary support; a second pulley of the central handle; a pulley of the second stationary support; a third pulley of the central handle; through the line passthrough hole; and wrapped around the line retention projection. An alternative embodiment of the shoulder exercise device includes a central handle with four pivoting pulley yokes instead of three and three stationary posts instead of two stationary posts.

Accordingly, it is an object of the present invention to provide a shoulder exercise device, which allows an individual to strengthen certain muscles of the shoulder without the aid of a therapist.

Finally, it is another object of the present invention to provide a shoulder exercise device, which may be mounted to a vertical surface, such as a wall.

These and additional objects, advantages, features and benefits of the present invention will become apparent from the following specification.

DETAILED DESCRIPTION OF THE PREFERRED EMBODIMENTS

Figure 1:
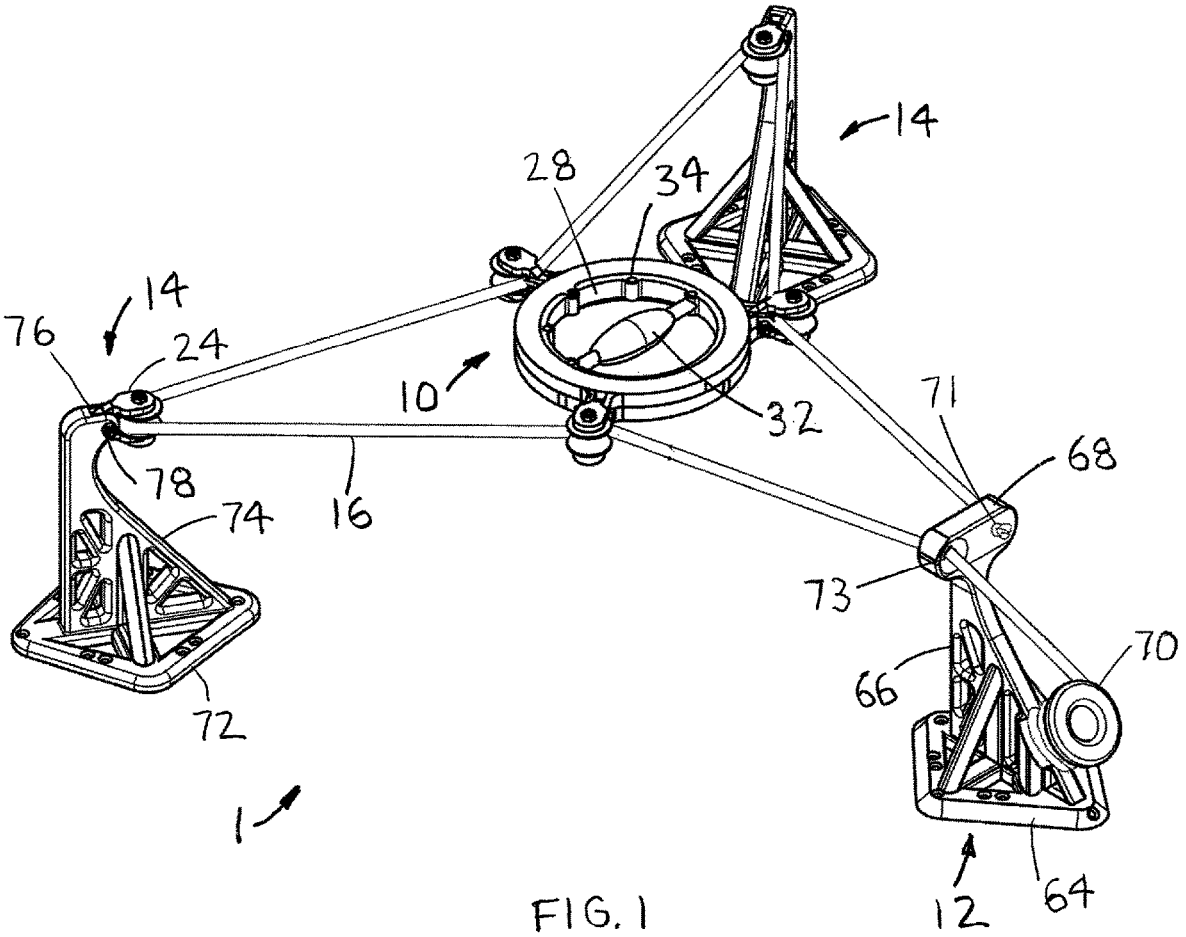
FIG. 1 is a perspective view of a shoulder exercise device having three support posts in accordance with the present invention.

With reference now to the drawings, and particularly to FIG. 1, there is shown a shoulder exercise device 1. The shoulder exercise device 1 preferably includes a central handle 10, a stationary origin post 12, at least two stationary posts 14 and a resistance line 16. With reference to FIGS. 2-5, the central handle 10 preferably includes an upper pivot ring 18, a lower pivot ring 20, a rotating handle 22, a plurality of pivoting pulley yokes 24 and a plurality line pulleys 26. The rotating handle 22 preferably includes a handle ring 28, a plurality of ball bearings 30 and a handle portion 32. Opposing ends of the handle portion 32 are attached to handle tabs 34, which extend from an inner perimeter of the handle ring 28. A bearing groove 36 is formed in an outer perimeter of the handle ring 28 to receive the plurality of ball bearings 30. The upper pivot ring 18 includes an upper handle bore 38 and a plurality of upper pivot extensions 40. The upper handle bore 38 is sized to receive the ball bearings 30 of the rotating handle 22. The upper and lower pivot rings 18, 20 are attached to each other with pins, fasteners or any other suitable attachment device or method. The plurality of upper pivot extensions 40 extend from an outer perimeter of the upper pivot ring 18. An upper pivot hole 42 is formed through each upper pivot extension 40. The lower pivot ring 20 includes a lower handle bore 44 and a plurality of lower pivot extensions 46. The lower handle bore 44 is sized to receive the ball bearings 30 of the rotating handle 22. The plurality of lower pivot extensions 46 extend from an outer perimeter of the lower pivot ring 20. A lower pivot hole 48 is formed through each lower pivot extension 46.

Each pivoting pulley yoke 24 includes a pulley yoke 50, a pivot tab 52 and the line pulley 26. The pivot tab 52 extends from the pulley yoke 50. The pulley yoke 50 includes an inner slot 54, which is sized to receive a thickness of the line pulley 26. A fastener hole 56 is formed through the pulley yoke 50 to receive a pulley fastener 58. The pulley fastener 58 pivotally retains the line pulley 26 in the pulley yoke 50. The line pulley 26 may include a ball bearing set or a bushing. A pivot hole 60 is formed through the pivot tab 52. The pivot hole 60 is preferably perpendicular to the pulley hole 56. A pivot fastener 62 is retained in the upper pivot hole 42, the lower pivot hole 48 and the pivot hole 60 to pivotally retain the pivoting pulley yoke 24. However, a ball joint may be used instead a pivot fastener 62 to pivot the pulley yoke relative to the central handle 10.

Figure 2:
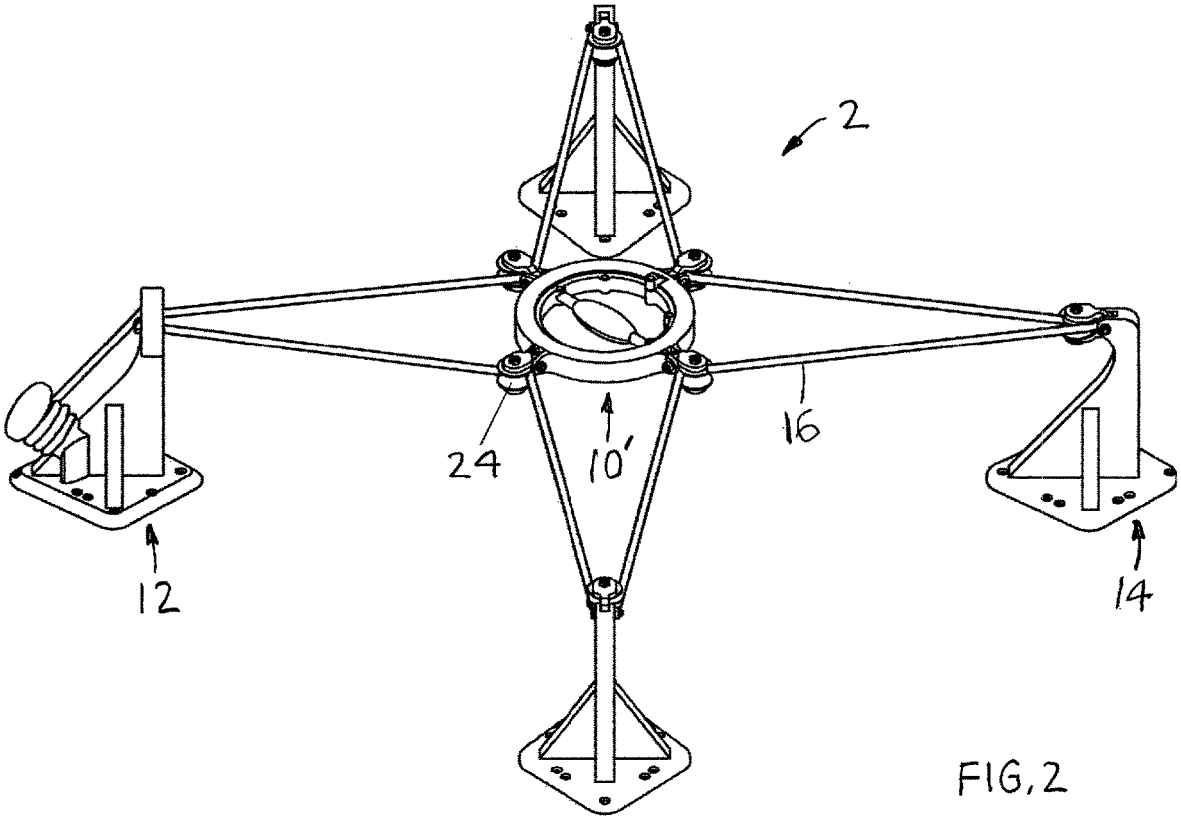
FIG. 2 is a perspective view of a shoulder exercise device having four support posts in accordance with the present invention.
Figure 3:
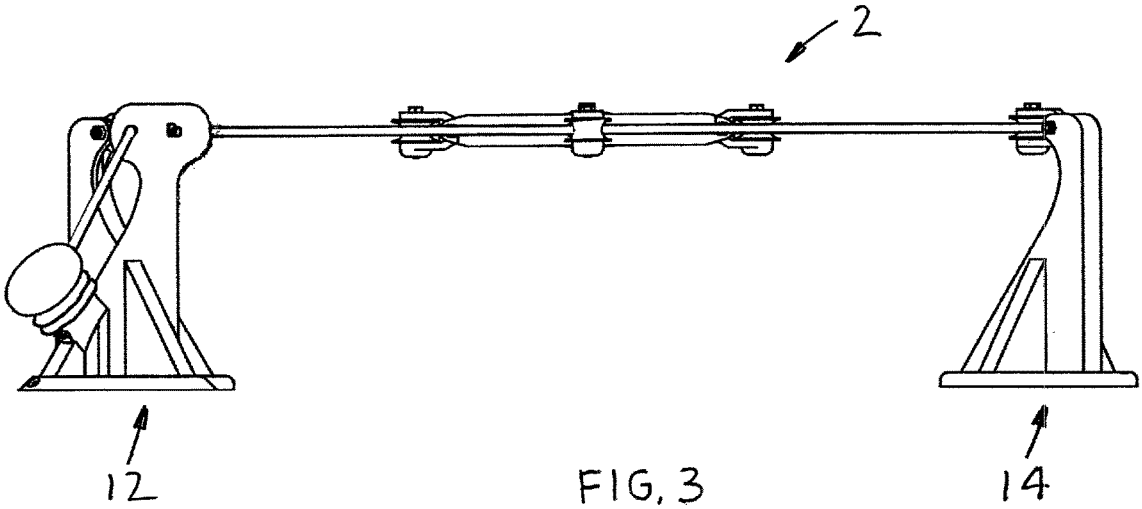
FIG. 3 is a front view of a shoulder exercise device having four support posts in accordance with the present invention.
Figure 4:
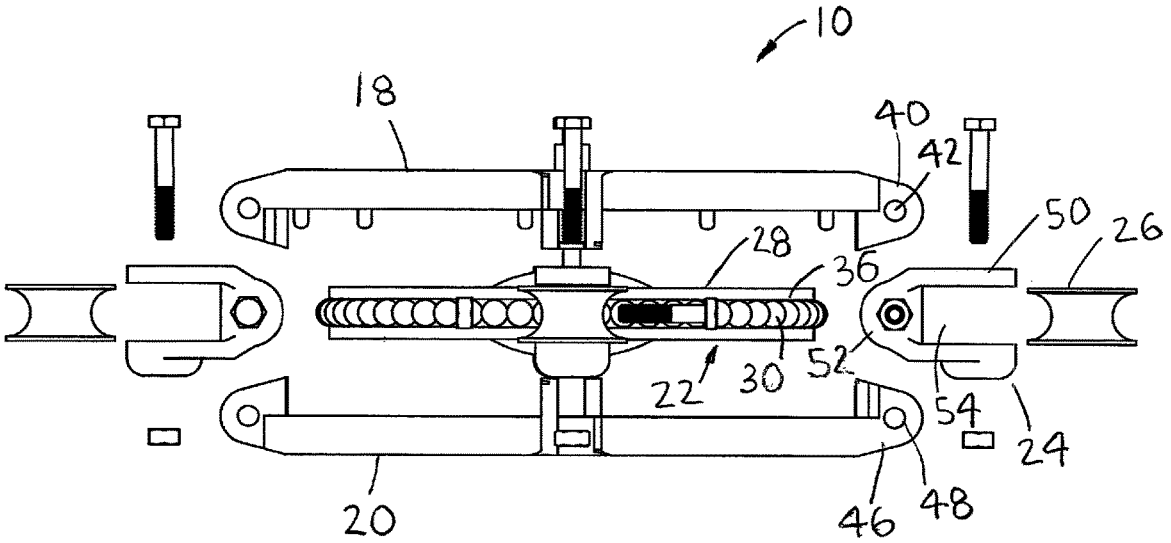
FIG. 4 is a front exploded view of a central handle of a shoulder exercise device in accordance with the present invention.
Figure 5:
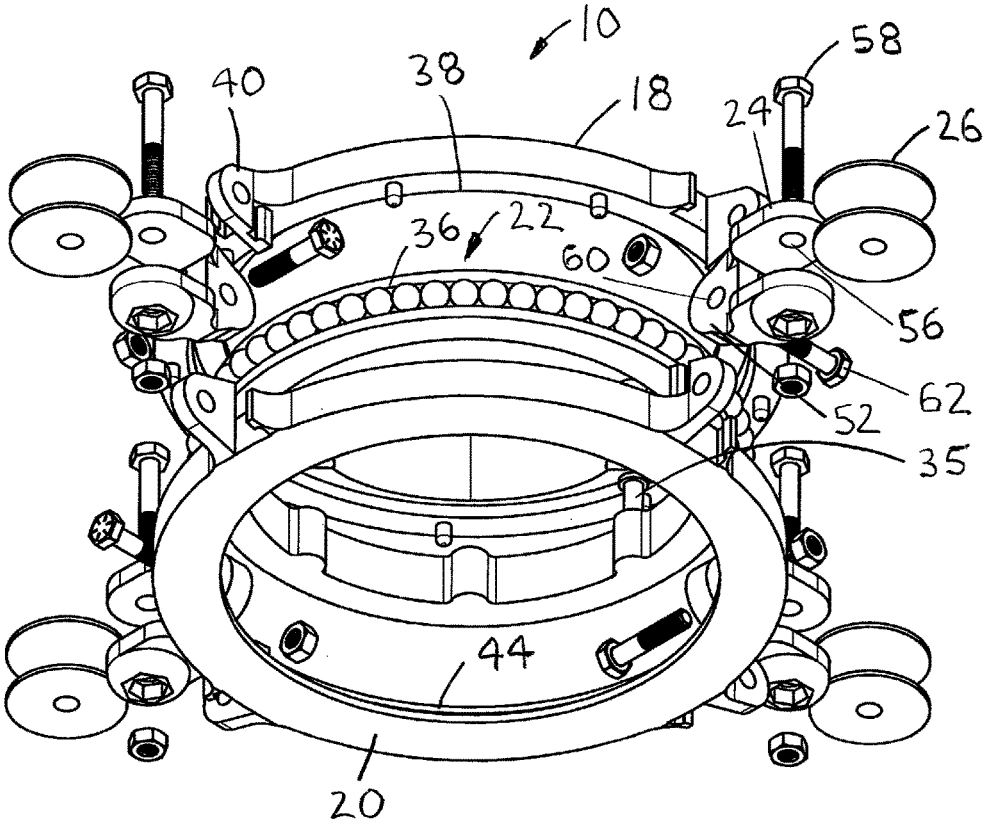
FIG. 5 is a perspective exploded view of a central handle of a shoulder exercise device in accordance with the present invention.

The stationary origin post 12 includes a stationary origin base 64, a stationary origin upright member 66, a line retainer 68 and a line retention projection 70. The origin upright member 66 extends upward from the stationary origin base 64. A top of the stationary origin upright member 66 is terminated with line retainer 68. The line retainer 68 includes a line origin hole 71 and a line passthrough hole 73. The line retention projection 70 extends from a rear of the stationary upright origin member. However, the line retention projection 70 may be replaced with a ratcheting crank and a reel or the like. The stationary post 14 includes a stationary base 72, a stationary upright member 74 and the pivoting pulley yoke 24. The stationary upright member 74 extends upward from the stationary base 72. A pivot slot 76 is formed in a top of the stationary upright member 74 to receive the pivoting pulley yoke 24. The pivoting pulley yoke 24 is pivotally engaged with the stationary upright member 74 with a pivot fastener 78. With reference to FIGS. 2-3, a shoulder exercise device includes a central handle 10', the stationary origin post 12, three stationary posts 14 and the resistance line 16. The central handle 10' includes four pivoting pulley yokes 24.

In use, the bases 64, 72 of the stationary origin post 12 and the stationary posts 14 are mounted to a vertical surface, such as a wall. The posts 12, 14 are secured to the vertical surface by inserting fasteners through the bases 64, 72. The posts 12, 14 are located on the vertical surface, such that a center of the handle portion 32 is at shoulder height of a user. One end of the resistance line 16 is inserted through the line origin hole 71 of the stationary origin post 12 and knotted to anchor thereof. It is preferable to have a bearing in the line origin hole 71 to prevent twisting of the resistance line 16, relative to the stationary origin post 12. The resistance line 16 is inserted through a first line pulley 26 of the central handle 10; the line pulley 26 of a first stationary support 14; a second pulley 24 of the central handle 22; the pulley 24 of the second stationary support 14; a third pulley 24 of the central handle 10; through the line passthrough hole 73; inserted through a hole (not shown) in the line retention projection 70; and wrapped around the line retention projection 70. The resistance line 16 is preferably fabricated from a resilient or elastic material, but could be fabricated from a non-resilient material. A spring could be used in conjunction with a non-elastic material. Further, a cable or rope could be terminated with removable weights instead of an elastic resistance line 16. The cable would have linear motion relative to the line retainer 68. The rotating handle 22 may be pinned to the upper pivot ring 18 and/or lower pivot rings 18, 20 to prevent rotation thereof with a pin or the like. The user may move the central handle 10 in a circular fashion, left, right, up, down or any angle in between to exercise their shoulder. The pivoting pulley yokes 24 enable the user to extend or retract the shoulder before moving the central handle 10 for exercises allowing for movements on multiple planes.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A shoulder exercise device, comprising:

a first post including a first base, a first upright member, a first line retainer, and a first line retention projection;

at least two second posts each including a second base, a second upright member, and a second line retainer;

a handle including a handle device and a plurality of third line retainers, said plurality of third line retainers extend from an outer perimeter of said handle; and a resistance line having one end secured to said first line retainer of said first post, wherein an opposing end of said resistance line is inserted through said plurality of third line retainers of said handle, said second line retainers of said at least two second posts, respectively, and said opposing end is secured to said first line retention projection of said first post.

2. The shoulder exercise device of claim 1, wherein:

said handle further comprises at least one pivot ring and said handle device includes a groove formed in an outer perimeter thereof, said groove is sized to receive a plurality of ball bearings, and said at least one pivot ring includes a bore sized to receive said plurality of ball bearings.

3. The shoulder exercise device of claim 2, further comprising:

said handle device includes a handle ring and a handle portion, a plurality of handle tabs extend from an inner perimeter of said handle ring, opposing ends of said handle portion are removably attachable to said plurality of handle tabs.

4. The shoulder exercise device of claim 3, wherein:

said handle device is capable of being rotated relative to said at least one pivot ring.

5. The shoulder exercise device of claim 1, wherein:

each one of said second and third line retainers is a pulley yoke, said pulley yoke includes a rotating line pulley.

6. The shoulder exercise device of claim 1, wherein:

said resistance line is fabricated from an elastic material.

7. The shoulder exercise device of claim 5, wherein:

each one of said plurality of pulley yokes includes a line pulley yoke, a pivot tab and a line pulley, said pivot tab extends from said pulley yoke, said pulley yoke includes an inner slot which is sized to receive a thickness of said line pulley, said line pulley is pivotally retained in said inner slot.

8. A shoulder exercise device, comprising:

a first post including a first base, a first upright member, a first line retainer, and a first line retention projection;

at least two second posts each including a second base, a second upright member, and a second line retainer;

a handle including at least one pivot ring, a handle device, and a plurality of third line retainers, said handle device is retained by said at least one pivot ring, and said plurality of third line retainers extend from an outer perimeter of said at least one pivot ring, respectively; and a resistance line having one end secured to said first line retainer of said first post, wherein an opposing end of said resistance line is inserted through said plurality of third line retainers of said handle, said second line retainers of said at least two second posts, respectively, and said opposing end is secured to said first line retention projection of said first post.

9. The shoulder exercise device of claim 8, further comprising:

said handle device includes a groove formed in an outer perimeter thereof, said groove is sized to receive a plurality of ball bearings, said at least one pivot ring includes a bore sized to receive said plurality of ball bearings.

10. The shoulder exercise device of claim 9, further comprising:

said handle device includes a handle ring and a handle portion, a plurality of handle tabs extend from an inner perimeter of said handle ring, opposing ends of said handle portion are removably attachable to said plurality of handle tabs.

11. The shoulder exercise device of claim 8, wherein:

said handle device is capable of rotating relative to said at least one pivot ring.

12. The shoulder exercise device of claim 8, wherein:

each one of said second and third line retainers is a pulley yoke, said pulley yoke includes a rotating line pulley.

13. The shoulder exercise device of claim 8, wherein:

said resistance line is fabricated from an elastic material.

14. The shoulder exercise device of claim 12, wherein:

each one of said plurality of pulley yokes includes a line pulley yoke, a pivot tab and a line pulley, said pivot tab extends from said pulley yoke, said pulley yoke includes an inner slot which is sized to receive a thickness of said line pulley, said line pulley is pivotally retained in said inner slot.

15. A shoulder exercise device, comprising:

a first post including a first base, a first upright member, a first line retainer, and a first line retention projection;

at least two second posts each including a second base, a second upright member, and a second line retainer;

a handle including an upper pivot ring, a lower pivot ring, a rotating handle, and a plurality of third line retainers, said rotating handle is retained between said upper and lower pivot rings, and said plurality of third line retainers extend from an outer perimeter of said upper and lower pivot rings, respectively; and a resistance line having one end secured to said first line retainer of said first post, wherein an opposing end of said resistance line is inserted through said plurality of third line retainers of said handle, said second line retainers of said at least two second posts, respectively, and said opposing end is secured to said first line retention projection of said first post.

16. The shoulder exercise device of claim 15, further comprising:

said rotating handle includes a groove formed in an outer perimeter thereof, said groove is sized to receive a plurality of ball bearings, said upper and lower pivot rings include a bore sized to receive said plurality of ball bearings.

17. The shoulder exercise device of claim 16, further comprising:

said rotating handle includes a handle ring and a handle portion, a plurality of handle tabs extend from an inner perimeter of said handle ring, opposing ends of said handle portion are removably attachable to said plurality of handle tabs.

18. The shoulder exercise device of claim 15, wherein:

said rotating handle is capable of being secured to at least one of said upper and lower pivot rings, such that said rotating handle does not rotate relative to said upper and lower pivot rings.

19. The shoulder exercise device of claim 15, wherein:

each one of said second and third line retainers includes a rotating line pulley, each one of said second and third line retainers pivots relative to said upper and lower pivot rings.

20. The shoulder exercise device of claim 15 wherein:

said resistance line is fabricated from an elastic material.

* * * * *